US011450239B2

(12) United States Patent
Adair et al.

(10) Patent No.: US 11,450,239 B2
(45) Date of Patent: Sep. 20, 2022

(54) FOLDABLE ARTICLE WITH SLICEFORM

(71) Applicant: Hallmark Cards, Incorporated, Kansas City, MO (US)

(72) Inventors: Michael Robert Adair, Overland Park, KS (US); Charity Robin Fluharty, Kansas City, MO (US); Takako Tokugawa, Tokyo (JP); Thomas A. Wallen, Merriam, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 0 days.

(21) Appl. No.: 16/694,535

(22) Filed: Nov. 25, 2019

(65) Prior Publication Data

US 2021/0158725 A1 May 27, 2021

(51) Int. Cl.
*G09F 1/06* (2006.01)

(52) U.S. Cl.
CPC ..... *G09F 1/06* (2013.01)

(58) Field of Classification Search
CPC ..... G09F 1/06; A63H 33/38; B42D 15/04; B42D 15/042
See application file for complete search history.

(56) References Cited

U.S. PATENT DOCUMENTS 1,052,187 A * 2/1913 Stranders ..... G09F 1/06 40/539
1,194,678 A * 8/1916 Stranders ..... G09F 1/06 40/539
3,090,144 A 5/1963 Malamude
3,235,988 A 2/1966 Paige
3,668,796 A 6/1972 Patterson
4,349,973 A 9/1982 Penick et al.
4,833,802 A 5/1989 Volkert
5,010,669 A 4/1991 Moran
5,022,681 A 6/1991 Penick
5,305,705 A 4/1994 Gagliano
5,450,680 A 9/1995 Bromberg
(Continued)

FOREIGN PATENT DOCUMENTS

DE 102005017383 A1 * 10/2006 ..... B42D 15/042
GB 2293575 A * 4/1996 ..... G09B 29/04

OTHER PUBLICATIONS

Yaroslav Mischenko, Postcard with slice-form heart, Jan. 16, 2012, https://www.flickr.com/photos/origami_ua/6841890515/in/photostream/, . (Year: 2012).*

(Continued)

*Primary Examiner* — Cassandra Davis
(74) *Attorney, Agent, or Firm* — Shook, Hardy & Bacon, L.L.P.

(57) ABSTRACT

A foldable article may have a first panel separated from a second panel by a fold, a paper mechanic affixed to at least one of the first panel and the second panel, and a sliceform affixed to the sliceform, the foldable article is movable between a closed state and a fully open state, the paper mechanic is configured to move the sliceform from a substantially two-dimensional, collapsed state to a substantially three-dimensional, expanded state when the foldable article is moved from the closed state to the fully open state.

18 Claims, 11 Drawing Sheets

(56) References Cited

U.S. PATENT DOCUMENTS

| | | | |
|---|---|---|---|
| 5,626,232 | A | 5/1997 | Volkert et al. |
| 5,682,999 | A | 11/1997 | Larson |
| 5,738,221 | A | 4/1998 | Van Witt et al. |
| 5,817,378 | A | 10/1998 | Otani |
| 5,933,989 | A | 8/1999 | Volkert et al. |
| 5,937,553 | A | 8/1999 | Maran |
| 6,238,762 | B1 | 5/2001 | Friedland et al. |
| 6,311,142 | B1 | 10/2001 | Glassner |
| 6,386,370 | B1 | 5/2002 | Wigton et al. |
| 6,966,135 | B1 | 11/2005 | McDonald |
| 7,490,425 | B2 | 2/2009 | Crowell et al. |
| 7,938,270 | B2 | 5/2011 | Davis |
| 8,499,478 | B1 | 8/2013 | Glass et al. |
| 9,334,076 | B2 | 5/2016 | Flynn |
| 9,475,333 | B2 | 10/2016 | Yeh |
| 9,524,658 | B1 | 12/2016 | Wise et al. |
| 9,542,865 | B2 | 1/2017 | Simmons |
| 9,601,033 | B2 | 3/2017 | Wise et al. |
| 9,643,443 | B2 | 5/2017 | Bogdanski et al. |
| 9,836,997 | B1 | 12/2017 | Brandrup |
| 9,842,516 | B2 | 12/2017 | Yeh |
| 9,873,280 | B1 | 1/2018 | Nelson et al. |
| 2003/0097773 | A1 | 5/2003 | Oh |
| 2006/0086015 | A1 | 4/2006 | Zlotnick et al. |
| 2007/0293118 | A1 | 12/2007 | Prescott |
| 2008/0016732 | A1 | 1/2008 | Gardi |
| 2008/0229633 | A1 | 9/2008 | Yi |
| 2008/0236000 | A1 | 10/2008 | Bostick |
| 2011/0047839 | A1 | 3/2011 | Ross et al. |
| 2012/0285861 | A1 | 11/2012 | Glass et al. |
| 2013/0191083 | A1 | 7/2013 | Bachrach et al. |
| 2016/0358515 | A1 | 12/2016 | Christiansen |
| 2016/0365010 | A1 | 12/2016 | Wise et al. |
| 2017/0148358 | A1 | 5/2017 | Wise et al. |
| 2017/0178544 | A1 | 6/2017 | Yeh |
| 2018/0102071 | A1 | 4/2018 | Yeh |

OTHER PUBLICATIONS

Yaroslav Mischenko, 111, Feb. 8, 2012, https://www.flickr.com/photos/origami_ua/6841899161/in/photostream/ (Year: 2012).*

"Automatic Sliding Tab Tutorial: Little Green Box", Wordpress.com, pp. 1-10 (Mar. 7, 2011).

"CUTPOPUP Orca Whale Card Pop Up, 3D Birthday Card Pop Up For Daughter, Son, Nephew, Niece—Wonderful Gift For Children, Kids, Teenager, Pre School On Birthday, Pool Swim Party, Christmas, New Year", Amazon.com, pp. 1-12 (Jan. 19, 2021).

International Preliminary Report on Patentability received for PCT Application No. PCT/US2019/034611, dated Dec. 10, 2020, 6 pages.

International Search Report and Written Opinion received for PCT Patent Application No. PCT/US2020/061954, dated Feb. 12, 2021, 8 pages.

Notice of Allowance dated Mar. 3, 2020 in U.S. Appl. No. 16/425,597, 5 pages.

International Preliminary Report on Patentability received in PCT Application No. PCT/US2020/061954, dated on Jun. 9, 2022, 7 pages.

* cited by examiner

FOLDABLE ARTICLE WITH SLICEFORM

FIELD

Aspects herein are related to a foldable article having a sliceform actuated by a paper mechanic.

BACKGROUND

Adding a sliceform to a greeting card has required the sliceform to straddle a fold of the greeting card in order for the sliceform to pop up from a two-dimensional configuration to a three-dimensional configuration when the greeting card is moved from a closed position to an open position. As a result, greeting card designers have only been able to position sliceforms in a center region of the card. This configuration also resulted in the orientation of the sliceform elements being limited to perpendicular to the greeting card when the greeting card is in the open position.

SUMMARY

At a high level, aspects herein are directed to a foldable article (e.g., a greeting card, book, magazine, etc.) having a fold separating a first panel from a second panel and a sliceform capable of popping up from a substantially two-dimensional configuration to a substantially three-dimensional configuration without the sliceform having to straddle the fold of the foldable article. The sliceform may be actuated between the substantially two-dimensional configuration and the substantially three-dimensional configuration by a paper mechanic. The paper mechanic extends across the fold of the foldable article and transfers the work of opening the foldable article to the sliceform. In some aspects, the paper mechanic may comprise a criss-cross lift, a box lift, or a collapsible lift. Utilizing a paper mechanic to actuate the sliceform provides many advantages. For example, the sliceform may be positioned at any location on either panel of the foldable article (e.g., entirely on the first panel or the second panel) and/or the sliceform may be uniquely oriented relative to the foldable article when in an expanded state (e.g., some of the planar elements of the sliceform extending parallel to the panels of the foldable article).

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
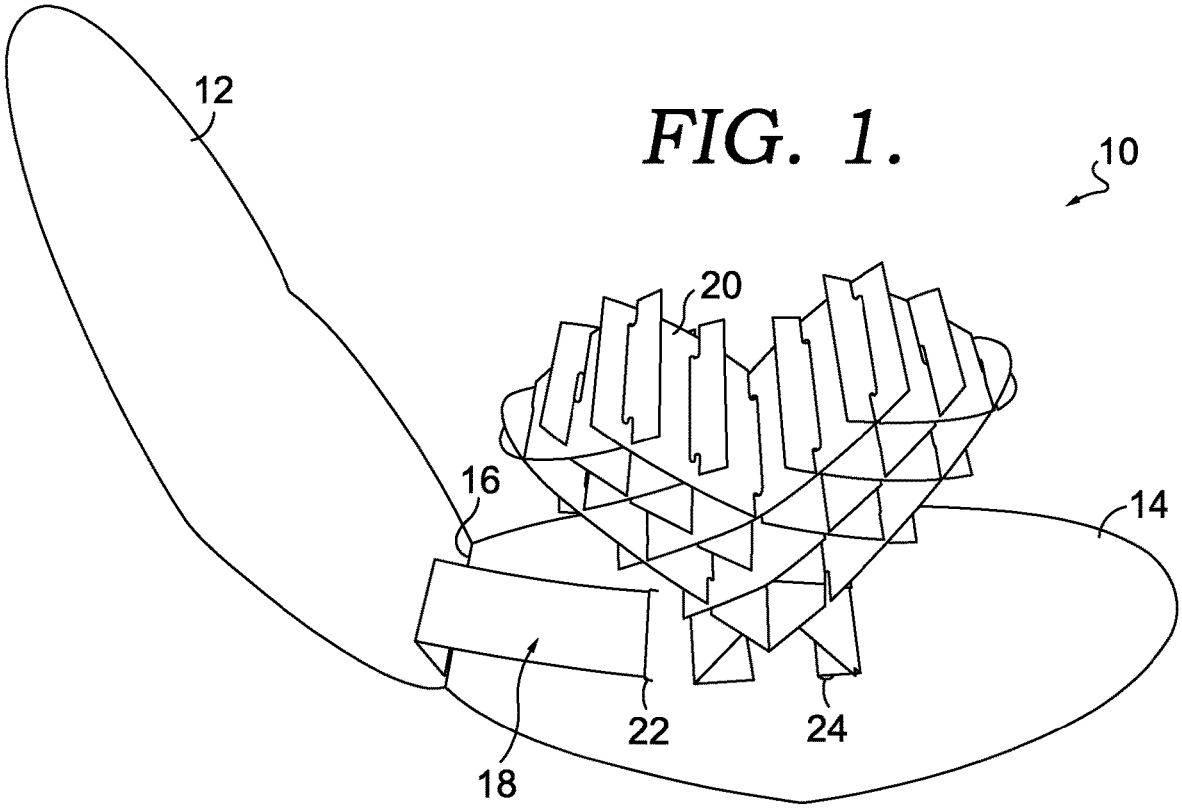
FIG. 1 depicts a perspective view of a foldable article, in accordance with aspects hereof.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a foldable article (e.g., a greeting card, book, magazine, etc.) having a fold separating a first panel from a second panel and a sliceform capable of popping up from a substantially two-dimensional configuration to a substantially three-dimensional configuration without the sliceform having to straddle the fold of the foldable article. The sliceform may be actuated between the substantially two-dimensional configuration and the substantially three-dimensional configuration by a paper mechanic. The paper mechanic extends across the fold of the foldable article and transfers the work of opening the foldable article to the sliceform. In some aspects, the paper mechanic may comprise a criss-cross lift, a box lift, or a collapsible lift. Utilizing a paper mechanic to actuate the sliceform provides many advantages. For example, the sliceform may be positioned at any location on either panel of the foldable article (e.g., entirely on the first panel or the second panel) and/or the sliceform may be uniquely oriented relative to the foldable article when in an opened position (e.g., some of the planar elements of the sliceform extending parallel to the panels of the foldable article).

Some aspects may be described using relative location terminology. For example, the term "proximate" is intended to mean on, about, near, by, next to, at, and the like. Therefore, when a feature is proximate another feature, it is close in proximity but not necessarily exactly at the described location, in some aspects. The term "substantially" when used in relation to angular orientation means within ±5 degrees of a designated value. Thus, when an element is substantially parallel to another element, it may be nearly parallel but not exactly parallel. For example, when sliceforms are in a collapsed state, each of the planar elements may be oriented such that they extend in nearly parallel directions, but not necessarily in exact parallel alignment with one another or with a panel of the foldable article.

Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are permanently attached to one another using, for example, stitching, bonding, welding, taping, stapling, and the like. The term "releasable fastener" as used herein refers to a fastener system that can be repeatedly coupled and uncoupled to respectively secure or disengage components from each other.

A foldable article may include any two panels that can move relative to one another about a fold from a folded state to an open state. For example, a foldable article may include a greeting card, a magazine, a book, and the like. The two panels may be connected to one another at a binding, in some aspects. In other aspects, the two panels may be integral to the foldable article and may comprise a unitary panel having a crease from one edge to an opposing edge. Other foldable articles may include more than two panels. For example, a unitary panel may be divided into three, four, or more subpanels that are each separated from adjacent subpanels by a crease. As used herein, the term "fold" refers to a segment about which two adjacent panels move relative to one another. For example, one of the panels may rotate about the fold.

As known to one skilled in the art, the term "paper mechanics" refers to a category of devices applied to foldable articles that cause motion upon opening of the foldable article. Although some paper mechanics are constructed from paper materials (e.g., paper strips), other paper mechanics are constructed from other materials (e.g., plastics, metal, wire, etc.). Several specific embodiments of paper mechanics will be discussed below with reference to the figures, however, it is envisioned that other types of paper mechanics known in the art may be useful for the present invention.

A "sliceform" may include a first plurality of planar elements coupled to a second plurality of planar elements, which are configured to move between a substantially two-dimensional, collapsed state and a substantially three-dimensional, expanded state. In some aspects, the first plurality of planar elements are coupled to the second plurality of planar elements via one or more slots. The term "slot" as used herein refers to an elongated opening formed through a portion of a planar element of a sliceform. In some aspects, a slot may include side edges that are immediately adjacent to one another (e.g., a slit). In other aspects, a slot may include side edges that are spaced apart from one another. Each of the planar elements may include one or more slots that receive a portion of another planar element. If the portion of the other planar element also includes a reciprocal slot, then the coupled planar elements may share a common profile at that position. Often, the planar elements comprise a two-dimensional panel in both the collapsed state and in the expanded state. In some aspects, however, some of the planar elements may comprise a three-dimensional panel in the expanded state. For example, these planar elements may comprise a two-dimensional panel having a fold and when the sliceform is in the expanded state these planar elements may only be partially unfolded.

Turning now to FIGS. 1-15, one embodiment of the present invention is depicted. Referring initially to FIG. 1, a foldable article 10 is assembled and in a partially opened state. The foldable article 10 includes a first panel 12, a second panel 14 separated from the first panel 12 by a fold 16, a paper mechanic 18, and a sliceform 20. In this aspect, the first panel 12 and the second panel 14 are constructed from a unitary panel and the fold 16 comprises a crease extending across the unitary panel from one edge to an opposing edge. In other aspects, the two panels may be affixed to one another at the fold 16.

Figure 2:
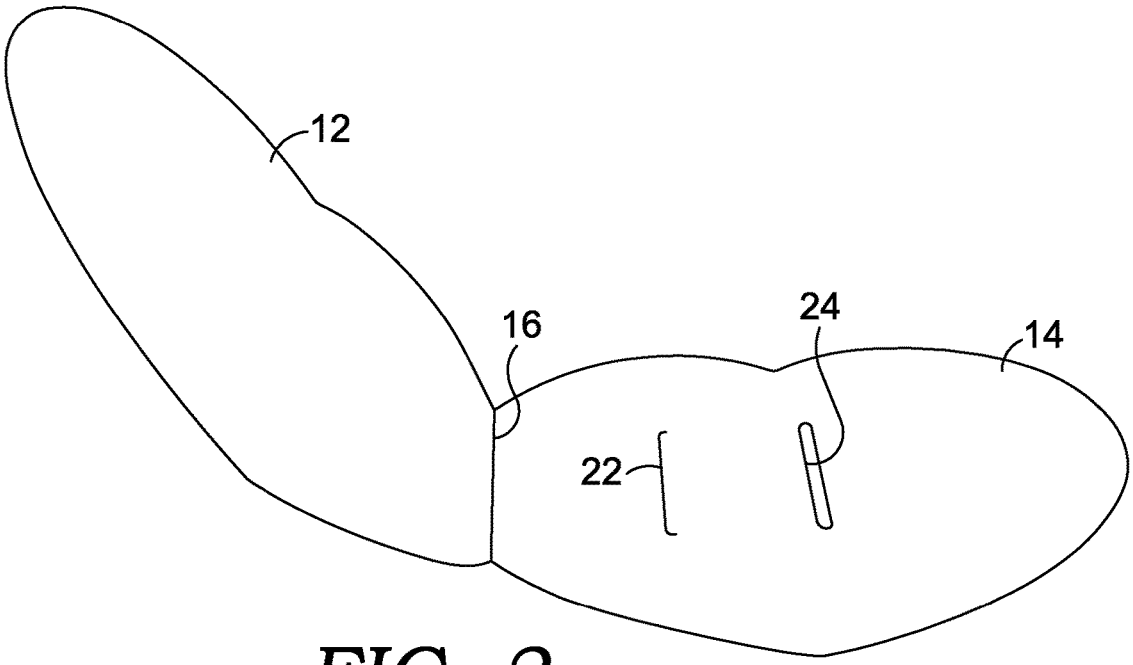
FIG. 2 depicts a perspective view of a first panel separated from a second panel by a fold of the foldable article of FIG. 1, in accordance with aspects hereof.

Turning to FIG. 2, the second panel 14 also includes a first opening 22 and a second opening 24, which are used for coupling the paper mechanic 18 to the foldable article 10. The first opening 22 has a narrow slit structure (i.e., the side edges are immediately adjacent one another presenting a closed appearance) while the second opening 24 has a slot structure (i.e., the side edges are not immediately adjacent one another presenting an open appearance). In other aspects, both openings may have the slit structure or the slot structure.

Also evident from FIG. 2 is that the first panel 12 and the second panel 14 may have any desired shape. The illustrated panels have a heart shape. The panels may also have other shapes (e.g., rectangular, square, or any other geometric or irregular shape), in accordance with some aspects. Similarly, each of the panels may not be the same size and/or have the same shape (e.g., the first panel may have a different shape than the second panel and the second panel may be larger than the first panel).

Figure 3:
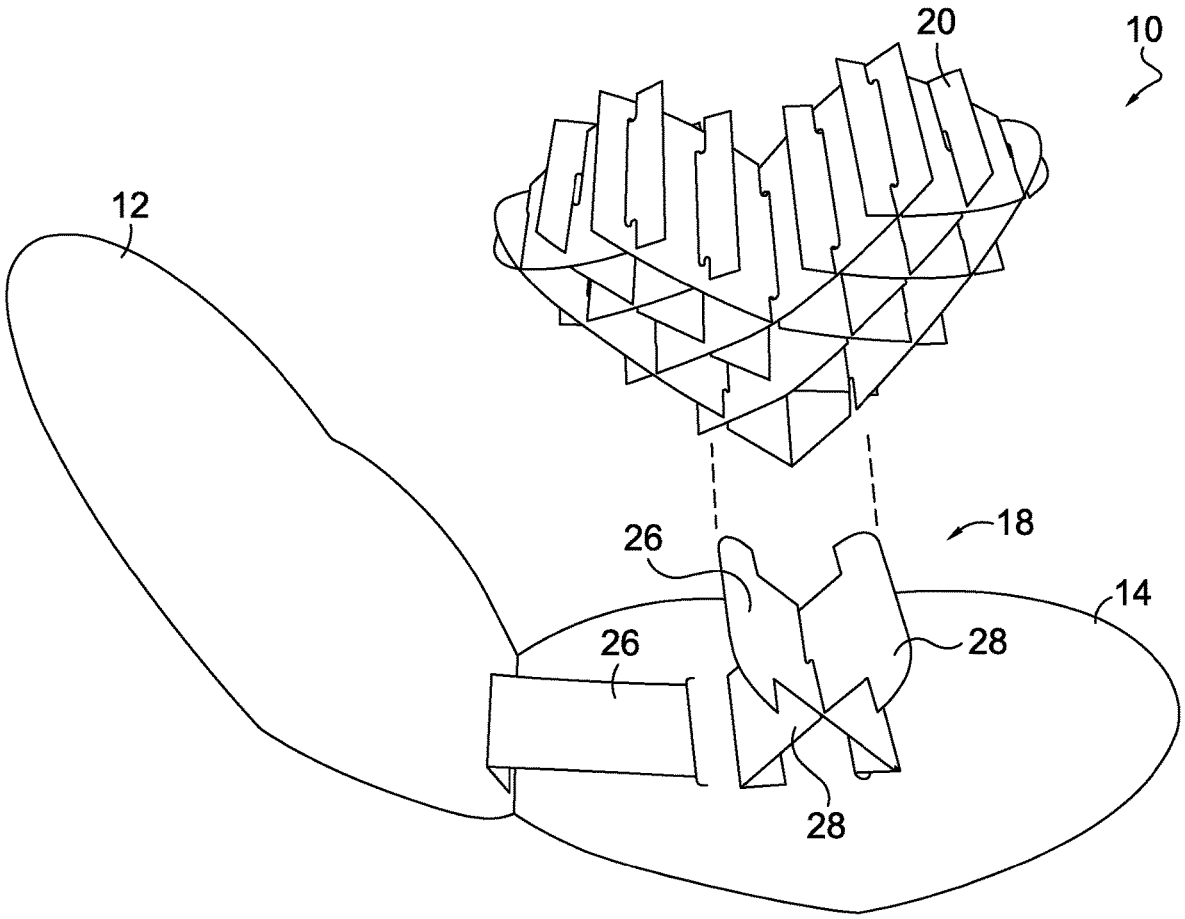
FIG. 3 depicts a perspective view of the foldable article of FIG. 1 with a sliceform detached from a paper mechanic, in accordance with aspects hereof.
Figure 4:
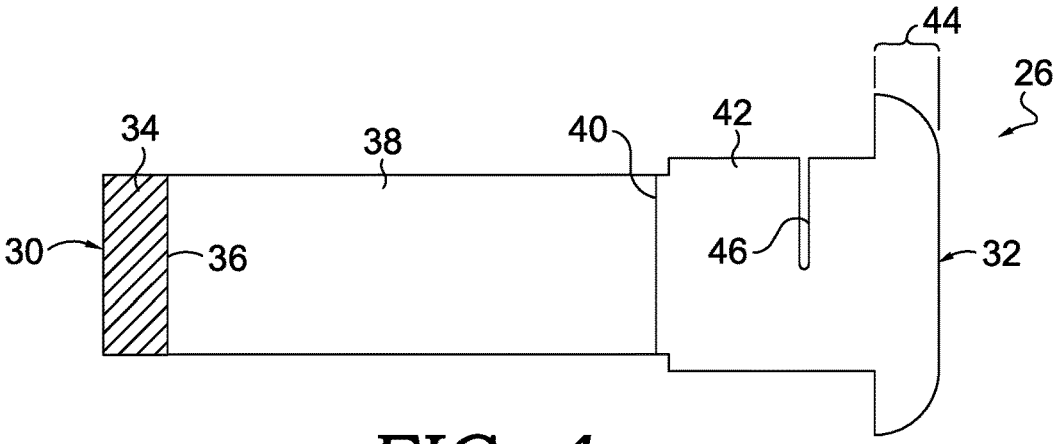
FIG. 4 depicts a top view of a first member of the paper mechanic of FIG. 3, in accordance with aspects hereof.
Figure 5:
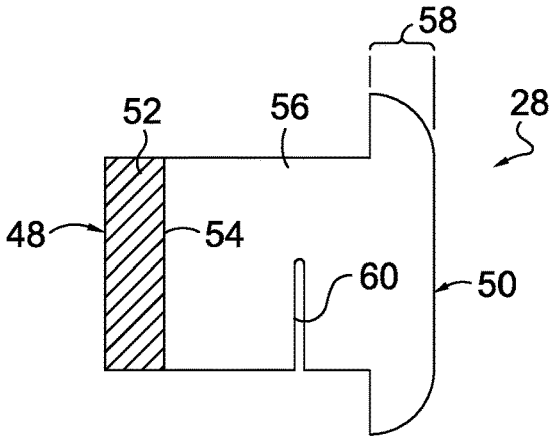
FIG. 5 depicts a top view of a second member of the paper mechanic of FIG. 3, in accordance with aspects hereof.

As best seen in FIGS. 3-5, the paper mechanic 18 comprises a criss-cross lift having a first member 26 and a second member 28. The first member 26 includes a first end 30 opposite a second end 32. The first end 30 includes a first coupling portion 34 and a first fold 36. A body 38 of the first member 26 extends from the first fold 36 to a second fold 40. A first leg 42 extends from the second fold 40 to a first coupling tab 44 of the second end 32. A first slot 46 is formed in the first leg 42 between the second fold 40 and the first coupling tab 44.

The second member 28 includes a third end 48 opposite a fourth end 50. The third end 48 includes a second coupling portion 52 and a third fold 54. A second leg 56 extends from the third fold 54 to a second coupling tab 58 of the fourth end 50. A second slot 60 is formed in the second leg 56 between the third fold 54 and the second coupling tab 58.

When the foldable article 10 is assembled, the first end 30 and the body 38 of the first member may be inserted through the second opening 24 and threaded back through the first opening 22 to slidably couple the first member 26 to the second panel 14. The first coupling portion 34 may be affixed to the first panel 12 in a desired position. In this way, the body 38 of the first member 26 may move relative to the second panel 14 as the foldable article 10 is moved between the open state and closed state. The second coupling portion may be affixed to the second panel 14 in a desired position. The first slot 46 and the second slot 60 may be aligned to receive a portion of the other member. The sliceform 20 may then be coupled to the first member 26 at the first coupling tab 44 and the second member 28 at the second coupling tab 58. In other words, the first coupling tab 44 is inserted through one of the slots of one of the first planar elements and the second coupling tab 58 is inserted through one of the slots of the second plurality of planar elements. Thus, the sliceform 20 may be removably coupled to the paper mechanic 18 by a slit-and-tab rather than by a non-removable coupling (e.g., bonding).

Figure 6:
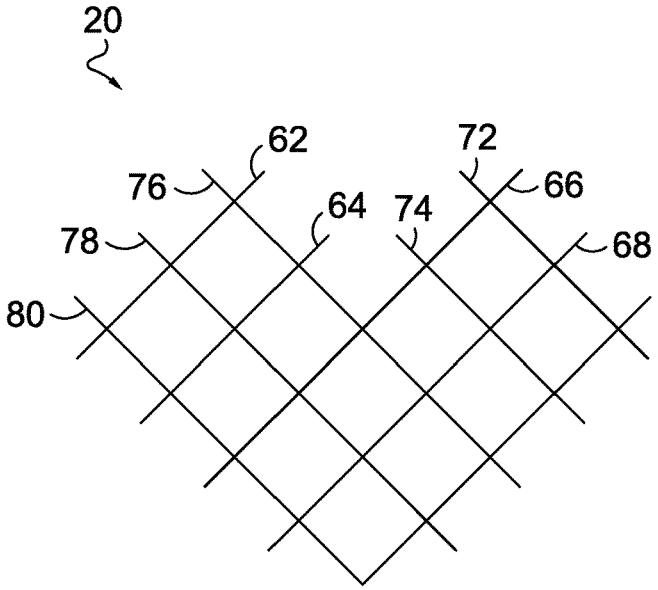
FIG. 6 depicts a front elevation view of the sliceform of FIG. 3, in accordance with aspects hereof.
Figure 7:
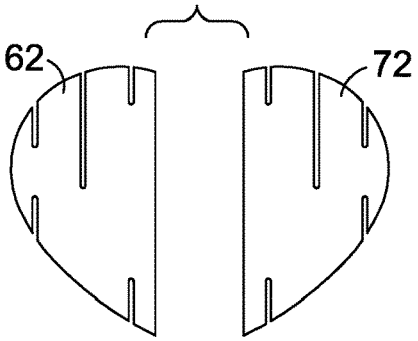
FIG. 7 depicts a top view of two planar elements of the sliceform of FIG. 3, in accordance with aspects hereof.
Figure 8:
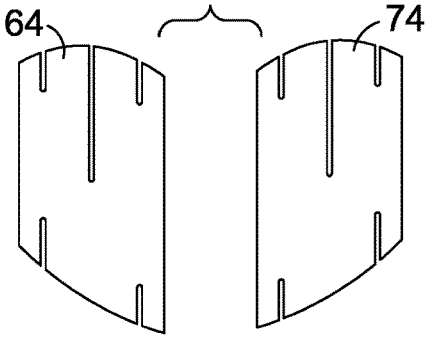
FIG. 8 depicts a top view of two planar elements of the sliceform of FIG. 3, in accordance with aspects hereof.
Figure 9:
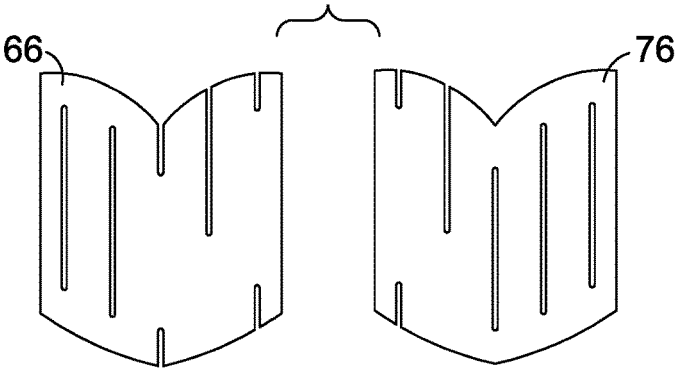
FIG. 9 depicts a top view of two planar elements of the sliceform of FIG. 3, in accordance with aspects hereof.
Figure 10:
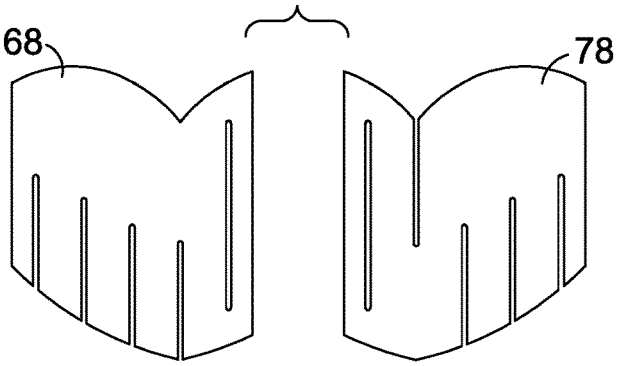
FIG. 10 depicts a top view of two planar elements of the sliceform of FIG. 3, in accordance with aspects hereof.
Figure 11:
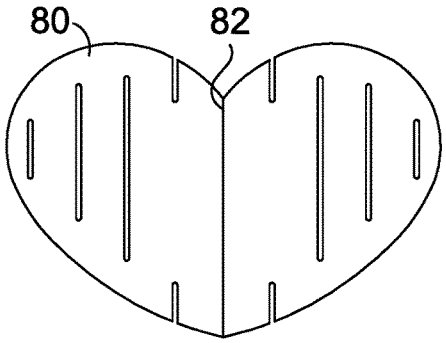
FIG. 11 depicts a top view of a planar element of the sliceform of FIG. 3, in accordance with aspects hereof.
Figure 12:
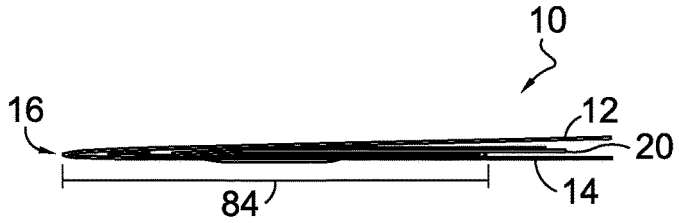
FIG. 12 depicts a front elevation view of the foldable article of FIG. 1 in a closed state, in accordance with aspects hereof.

An isometric view of the sliceform 20 in an expanded state is shown in FIGS. 1 and 3. An elevation view of the sliceform 20 is shown in FIG. 6, which illustrates that the sliceform 20 includes nine planar elements. FIGS. 7-11 illustrate each of the nine planar elements 62, 64, 66, 68, 72, 74, 76, 78 and 80. Planar element 80 is different from the other planar elements in that it includes a fourth fold 82 allowing it to both lay flat when the sliceform 20 is in the collapsed state and to be aligned with the first plurality of planar elements 62, 64, 66, and 68 in part and with the second plurality of planar elements 72, 74, 76, and 78 in part when the sliceform 20 is in the expanded state. In other aspects, the planar element 80 may comprise two separate planar elements—one a part of the first plurality of planar elements 62, 64, 66, and 68 and one a part of the second plurality of planar elements 72, 74, 76, and 78.

Each of the planar elements 62, 64, 66, 68, 72, 74, 76, 78 and 80 may include one or more slots, as illustrated in FIGS. 7-11. The first plurality of planar elements 62, 64, 66, and 68 have reciprocal slots to those of the second plurality of planar elements 72, 74, 76, and 78. These reciprocal slots enable the sliceform 20 to have the symmetrical shape necessary to form a three-dimensional heart when the sliceform 20 is in the expanded state. It is contemplated, however, that in other aspects it may be advantageous for the slots not be reciprocal or a mirror image between the first plurality of planar elements 62, 64, 66, and 68 and the second plurality of planar elements 72, 74, 76, and 78. For example, when a non-symmetrical, three-dimensional design is desired, the slots will not be reciprocal or a mirror image.

Figure 13:
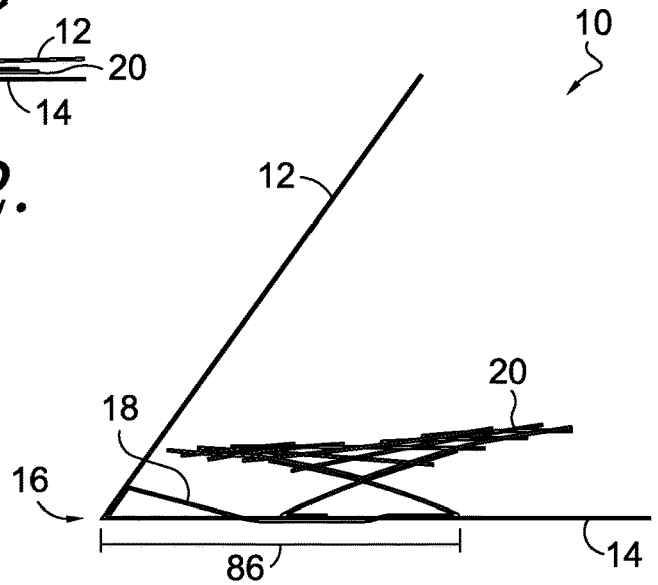
FIG. 13 depicts a front elevation view of the foldable article of FIG. 1 in a partially open state, in accordance with aspects hereof.
Figure 14:
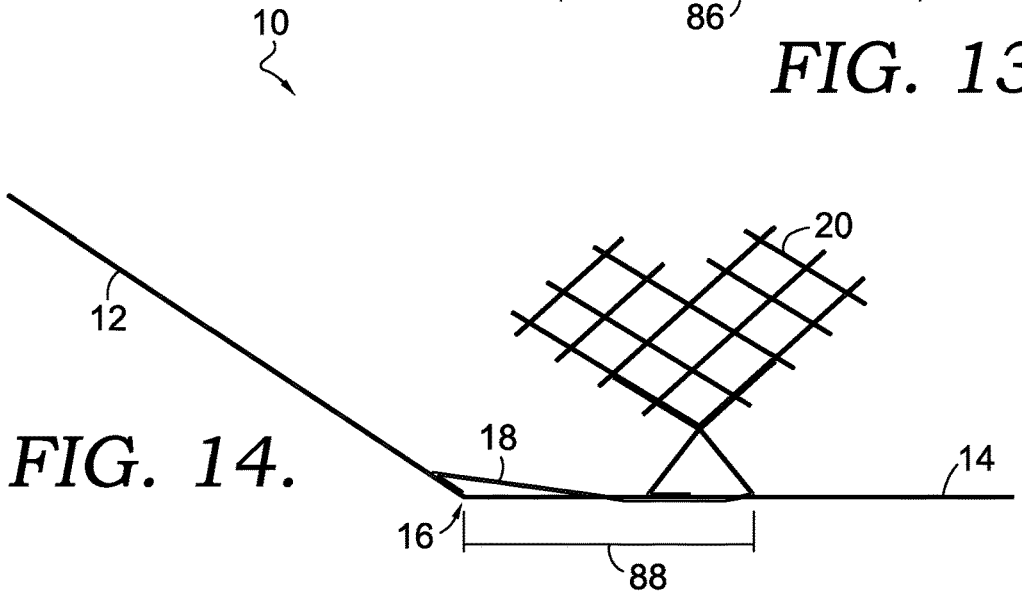
FIG. 14 depicts a front elevation view of the foldable article of FIG. 1 in a mostly open state, in accordance with aspects hereof.
Figure 15:
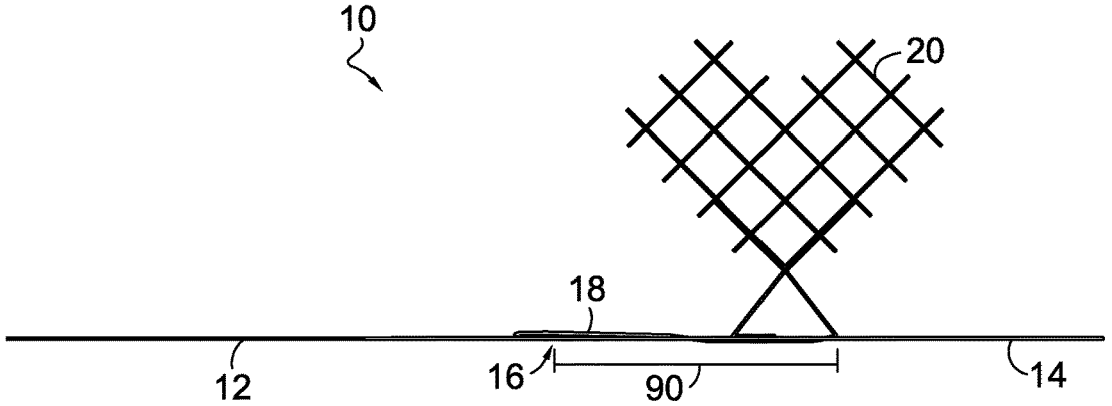
FIG. 15 depicts a front elevation view of the foldable article of FIG. 1 in a fully open state, in accordance with aspects hereof.

Referring to FIGS. 12-15, front elevation views illustrate the foldable article 10 moving from the closed state (FIG. 12) to the fully opened state (FIG. 15). When the foldable article 10 is in the closed state, both the paper mechanic 18 and the sliceform 20 are in a substantially two-dimensional configuration. In other words, the paper mechanic 18 and the sliceform 20 lay flat within the foldable article 10 between the first panel 12 and the second panel 14. In this state, the second fold 40 of the first member 26 of the paper mechanic 18 is spaced a first distance 84 from the fold 16. The first distance 84 is the farthest distance the second fold 40 is positioned from the fold 16, when the foldable article 10 is assembled.

Turning to FIG. 13, the foldable article 10 has moved from the closed state (FIG. 12) to a partially open state. The first panel 12 has been rotated away from the second panel 14 approximately forty-five degrees. The paper mechanic 18 has moved and begun to transition the sliceform 20 from the collapsed state to the expanded state. The second fold 40 of the first member 26 of the paper mechanic 18 is spaced a second distance 86 from the fold 16, which is shorter than the first distance 84.

In FIG. 14, the foldable article 10 has moved from the partially open state (FIG. 13) to a mostly open state. The first panel 12 has been rotated away from the second panel 14 approximately one-hundred thirty-five degrees. The paper mechanic 18 has moved and substantially transitioned the sliceform 20 from the collapsed state to the expanded state. The second fold 40 of the first member 26 of the paper mechanic 18 is spaced a third distance 88 from the fold 16, which is shorter than the second distance 86.

FIG. 15 illustrates the foldable article 10 in the fully open state. The first panel 12 has been rotated away from the second panel 14 approximately one-hundred eighty degrees. The paper mechanic 18 has moved and completely transitioned the sliceform 20 to the expanded state. The second fold 40 of the first member 26 of the paper mechanic 18 is spaced a fourth distance 90 from the fold 16, which is shorter than the third distance 88.

Thus, as with the embodiment described above, it is no longer necessary for the sliceform 20 to be positioned such that it straddles the fold 16. Rather, it may be positioned at any location on either of the first panel 12 or the second panel 14. Further, the sliceform 20 need not even be affixed to the first panel 12 or the second panel 14 and may be affixed only to the paper mechanic 18. In so doing, the sliceform 20 may have a unique orientation such that the passageways defined by the planar elements 62, 64, 66, 68, 72, 74, 76, 78 and 80 when in the expanded configuration need not extend normal to the first panel 12 or the second panel 14 when the foldable article 10 is in the fully open state. All of the planar elements of prior art sliceforms attached to greeting cards were oriented with the passageways extending normal to the greeting card in a fully open state, which only provided a design profile to be viewed from the side. Greeting cards, and other foldable articles, are often opened and viewed from the top, thus the present invention permits the designer options to provide a design profile that may be viewed from the top rather than the side.

Indeed, using a criss-cross lift for the paper mechanic 18 further provides the option to set the planar elements 62, 64, 66, 68, 72, 74, 76, 78 and 80 at an angle to the first panel 12 and the second panel 14 when the foldable article 10 is in the fully open state. For example, the first plurality of planar elements 62, 64, 66, and 68 may be held at an angle 45 degrees from the second panel 14 when the foldable article 10 is in the fully open state. Likewise, the second plurality of planar elements 72, 74, 76, and 78 may be held at an angle of 135 degrees from the second panel 14. These angles relative to the first panel 12 and the second panel 14 or relative to one another may be modified by changing the distance the second fold 40 travels or the lengths of the first leg 42 and the second leg 56.

Figure 16:
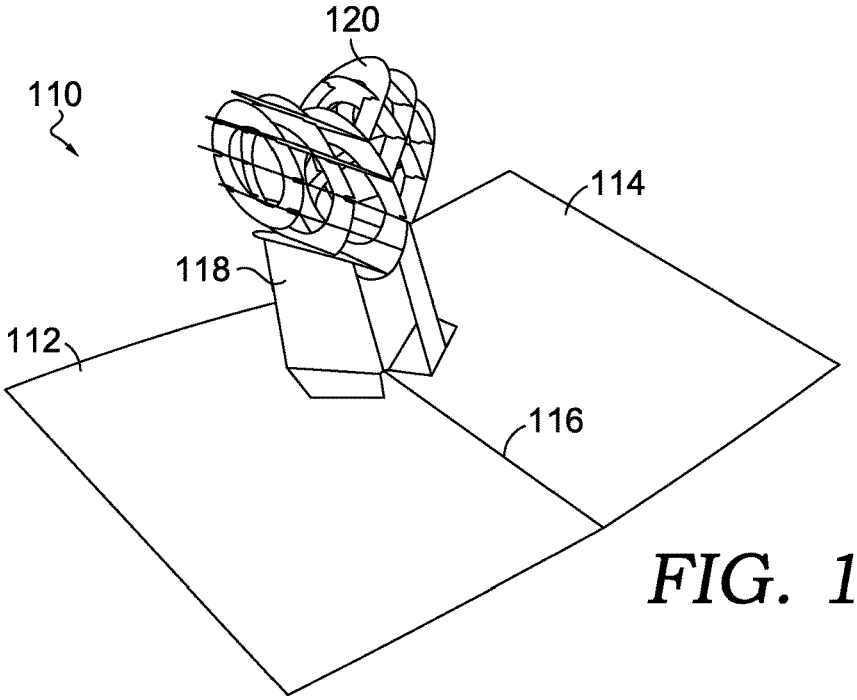
FIG. 16 depicts a perspective view of a foldable article, in accordance with aspects hereof.
Figure 17:
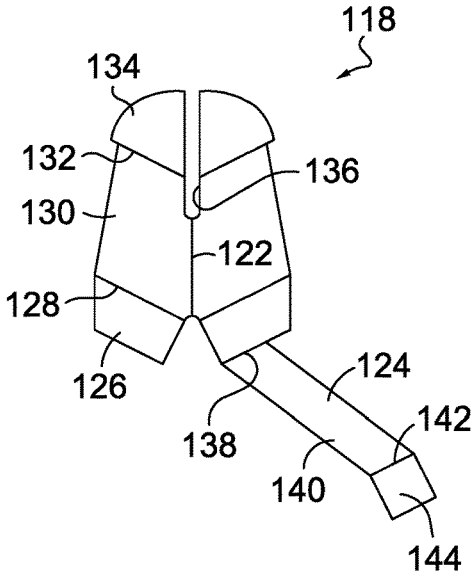
FIG. 17 depicts a top view of a paper mechanic of the foldable article of FIG. 16, in accordance with aspects hereof.

Turning now to FIGS. 16-28, another embodiment of the present invention is depicted. Referring initially to FIG. 16, a foldable article 110 is much the same as the foldable article 10 described above, but with a few distinctions noted below. Generally, the foldable article 110 includes a first panel 112 movable relative to a second panel 114 at a fold 116, a paper mechanic 118, and a sliceform 120. Both the paper mechanic 118 and the sliceform 120 are different from what was described above.

In this embodiment, the paper mechanic 118 comprises a collapsible lift (sometimes referred to as a "sno-cone lift"). The paper mechanic 118 is shown unassembled in FIG. 17, and includes two mirror image portions mirrored across a first fold 122 and a strut 124 extending from one of the two mirror image portions. Each of the mirror image portions includes a base portion 126, a second fold 128, a body 130, a third fold 132, and a header 134. A slot 136 may extend in linear alignment with the first fold 122, for receiving a portion of the sliceform 120 therein. The strut 124 extends from one of the base portions 126. In the illustrated aspect, the strut 124 is integral to the paper mechanic 118 and extends from a fourth fold 138. In other aspects, however, the strut 124 may be affixed to one of the base portions 126. The strut 124 includes a leg 140, a fifth fold 142, and a coupling portion 144.

When assembled, one of the base portions 126 is affixed to the first panel 112 and the other of the base portions 126 is affixed to the second panel 114 such that the first fold 122 is in parallel alignment with the fold 116. Each of the header portions 134 is affixed to a sliceform base member 146 on opposite sides of a sliceform fold 149. The strut 124 extends from the fourth fold 138 to the fifth fold 142 and the coupling portion 144 is affixed to one or more of the sliceform base member 146 or one of the headers 134.

Figure 18:
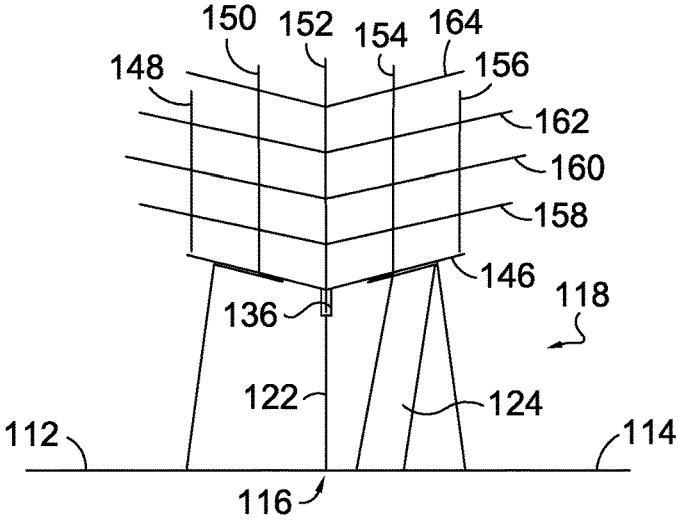
FIG. 18 depicts a front elevation view of the foldable article of FIG. 16, in accordance with aspects hereof.
Figure 19:
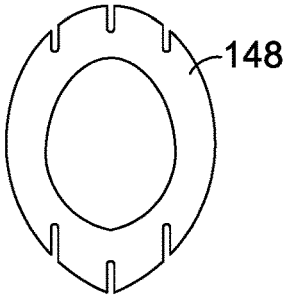
FIG. 19 depicts a top view of a planar element of the sliceform of FIG. 16, in accordance with aspects hereof.
Figure 20:
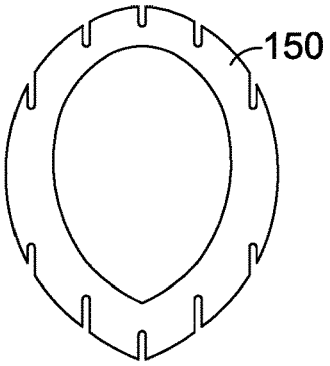
FIG. 20 depicts a top view of a planar element of the sliceform of FIG. 16, in accordance with aspects hereof.
Figure 21:
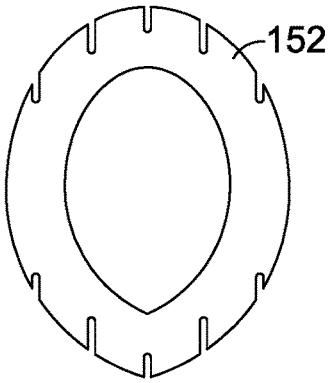
FIG. 21 depicts a top view of a planar element of the sliceform of FIG. 16, in accordance with aspects hereof.
Figure 22:
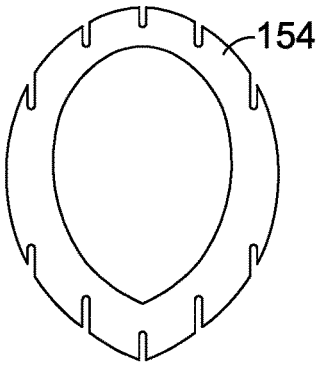
FIG. 22 depicts a top view of a planar element of the sliceform of FIG. 16, in accordance with aspects hereof.
Figure 23:
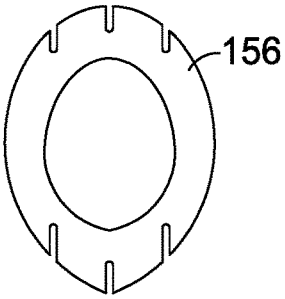
FIG. 23 depicts a top view of a planar element of the sliceform of FIG. 16, in accordance with aspects hereof.
Figure 24:
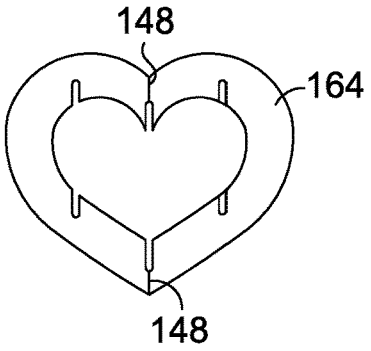
FIG. 24 depicts a top view of an angular element of the sliceform of FIG. 16, in accordance with aspects hereof.
Figure 25:
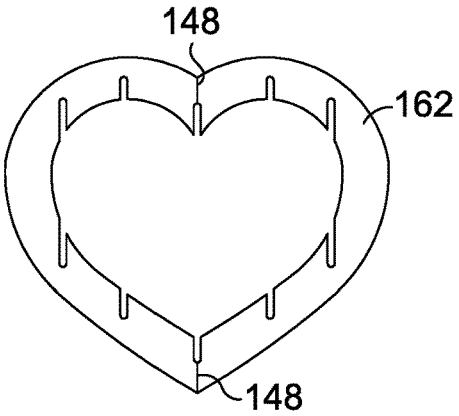
FIG. 25 depicts a top view of an angular element of the sliceform of FIG. 16, in accordance with aspects hereof.
Figure 26:
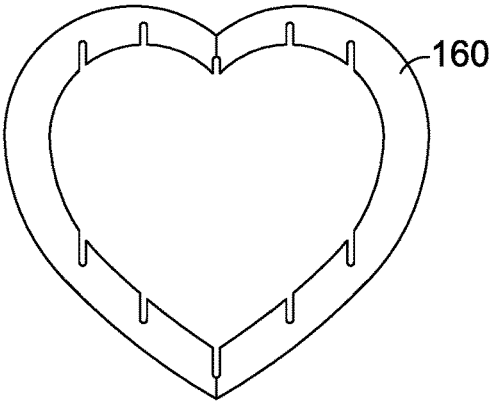
FIG. 26 depicts a top view of an angular element of the sliceform of FIG. 16, in accordance with aspects hereof.
Figure 27:
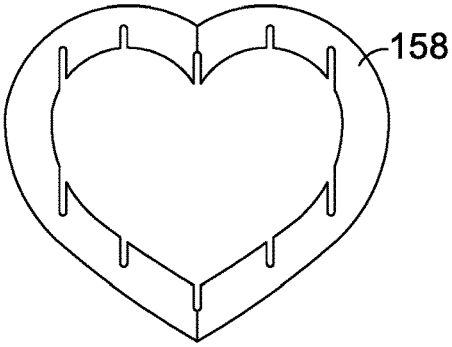
FIG. 27 depicts a top view of an angular element of the sliceform of FIG. 16, in accordance with aspects hereof.
Figure 28:
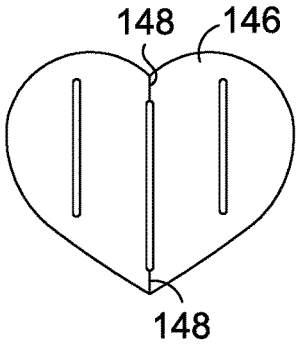
FIG. 28 depicts a top view of an angular element of the sliceform of FIG. 16, in accordance with aspects hereof.

The sliceform 120 includes a plurality of planar elements 148, 150, 152, 154, and 156 and a plurality of angular elements 146, 158, 160, 162, and 164. FIG. 18 depicts a front elevation view of the foldable article 110 in an open state and the slice form 120 in an expanded state. FIGS. 19-23 depict the plurality of planar elements 148, 150, 152, 154, and 156, which are substantially the same as the planar elements described above, except that planar elements 150 and 154 include a tab that extends through a slot in the slice form base member 146 and is affixed thereto. FIGS. 24-28 depict the plurality of angular elements 146, 158, 160, 162, and 164.

The plurality of angular elements 146, 158, 160, 162, and 164 are similar to the planar elements described herein, except that they each include the sliceform fold 149. Thus, when the sliceform 120 is in the two-dimensional, collapsed state, the plurality of angular elements 146, 158, 160, 162, and 164 are each folded over to a substantially two-dimensional position. When the sliceform 120 is in the three-dimensional, expanded state, the plurality of angular elements 146, 158, 160, 162, and 164 are at least partially unfolded. In the illustrated aspect, the sliceform fold 149 is in linear alignment with each of the first fold 122 and the fold 116.

Similar to the embodiment discussed above, the foldable article 110 moves between a closed state and a fully open state (shown in FIG. 16). When the foldable article 110 is in the closed state, the paper mechanic 118 and the sliceform 120 are in a substantially two-dimensional, collapsed state. In other words, the paper mechanic 118 and the sliceform 120 lay flat within the foldable article 110 between the first panel 112 and the second panel 114. In this collapsed state, the two bodies 130 of the paper mechanic 118 have folded together about the first fold 122 and have folded forwardly about the two second folds 128. The strut 124 also folds forwardly about the fourth fold 138, in this state. The plurality of planar elements 148, 150, 152, 154, and 156 are in a lowered position, but have not changed orientation, in this state. The plurality of angular elements 146, 158, 160, 162, and 164 have folded about the sliceform fold 149 to become substantially parallel with the plurality of planar elements 148, 150, 152, 154, and 156. Also in this state, the header portions 134 have folded about the third folds 132 and followed the fold of the sliceform base member 146.

When the foldable article 110 is in the fully open state, the paper mechanic 118 and the sliceform 120 are in a substantially three-dimensional, expanded state. In this expanded state, the two bodies 130 of the paper mechanic 118 have unfolded about the first fold 122 and have unfolded rearwardly about the two second folds 128. In other words, when viewed from the side elevation the paper mechanic 118 and thereby the sliceform 120 pivot rearwardly in the direction of the fold 116 when the foldable article 110 is moved from the closed state to the fully open state. The strut 124 also unfolds rearwardly about the fourth fold 138, in this state. The plurality of planar elements 148, 150, 152, 154, and 156 are in a raised position, but have not changed orientation, in this state. The plurality of angular elements 146, 158, 160, 162, and 164 have unfolded about the sliceform fold 149 to extend at an angle to the plurality of planar elements 148, 150, 152, 154, and 156. In other aspects, the plurality of angular elements 146, 158, 160, 162, and 164 may extend normal to the plurality of planar elements 148, 150, 152, 154, and 156. Also in this state, the header portions 134 have unfolded about the third folds 132 and followed the unfolding of the sliceform base member 146.

The angle from which the plurality of angular elements 146, 158, 160, 162, and 164 extend relative to the plurality of planar elements 148, 150, 152, 154, and 156 and the amount the paper mechanic 118 and thus the sliceform 120 pivot in the direction of the fold 116 may be controlled in various ways. For example, the expanded state may be modified by changing the length of the bodies 130, the length of the leg 140 of the strut 124, the angle at which the second folds 128 extend from the fold 116, or the angle at which the third folds 132 extend relative to the fold 116.

Thus, as with the embodiment described above, it is no longer necessary for the sliceform 120 to be affixed to the first panel 112 or the second panel 114 and may be affixed only to the paper mechanic 118. In so doing, the sliceform 120 may have a unique orientation such that the passageways defined by the plurality of planar elements 148, 150, 152, 154, and 156 and the plurality of angular elements 146, 158, 160, 162, and 164 when in the expanded state need not extend normal to the first panel 112 or the second panel 114 when the foldable article 110 is in the fully open state. All of the planar elements of prior art sliceforms attached to greeting cards were oriented with the passageways extending normal to the greeting card in a fully open state, which only provided a design profile to be viewed from the side. Greeting cards, and other foldable articles, are often opened and viewed from the top, thus the present invention permits the designer options to provide a design profile that may be viewed from the top rather than the side.

Figure 29:
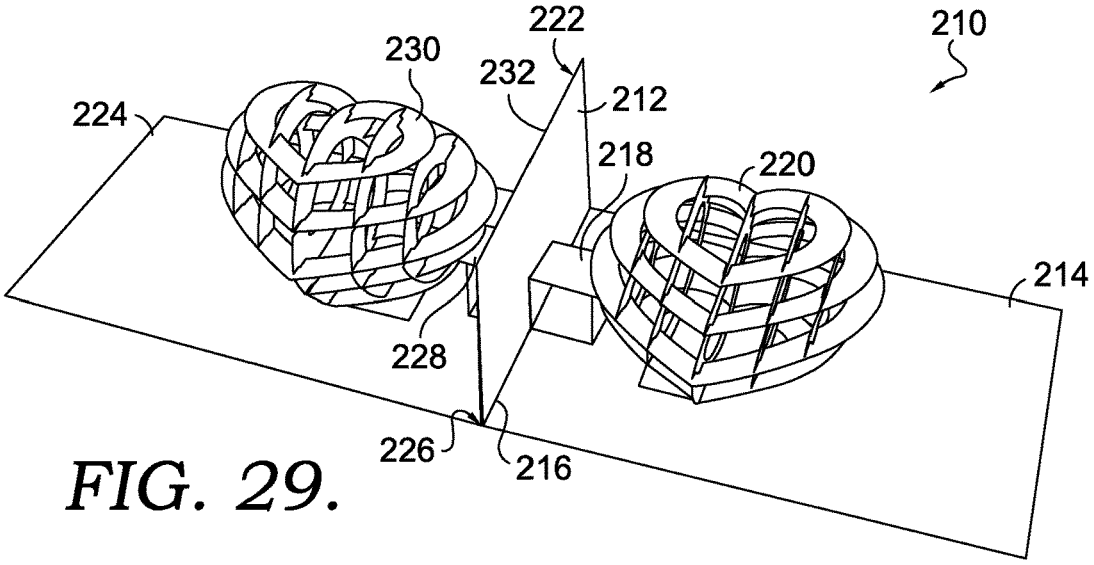
FIG. 29 depicts a perspective view of a foldable article, in accordance with aspects hereof.

Turning now to FIGS. 29-41, another embodiment of the present invention is depicted. Referring initially to FIG. 29, a foldable article 210 includes a first panel 212 movable relative to a second panel 214 at a first panel fold 216, a first paper mechanic 218, a first sliceform 220, a third panel 222 movable relative to a fourth panel 224 at a second panel fold 226, a second paper mechanic 228, a second sliceform 230, and a third panel fold 232 separating the first panel 212 from the third panel 222. Thus, the four panels are integral to a unitary panel and separated from adjacent panels by the panel folds. The order of the panels from left to right, as viewed in FIG. 29, is the fourth panel 224, the third panel 222 (affixed to the back side of the first panel 212), the first panel 212, and the second panel 214. Essentially, every element on one side of the third panel fold 232 is a mirror image of a like element on the other side of the third panel fold 232. Thus, for sake of brevity, the following description will focus only on the first panel 212, the second panel 214, the first panel fold 216, the first paper mechanic 218, and the first sliceform 220. Such description, however, applies equally to the mirror image elements on the other side of the third panel fold 232. It is also contemplated that in alternative aspects, the foldable article 210 may only have the first panel 212, the second panel 214, the first panel fold 216, the first paper mechanic 218, and the first sliceform 220.

Figure 30:
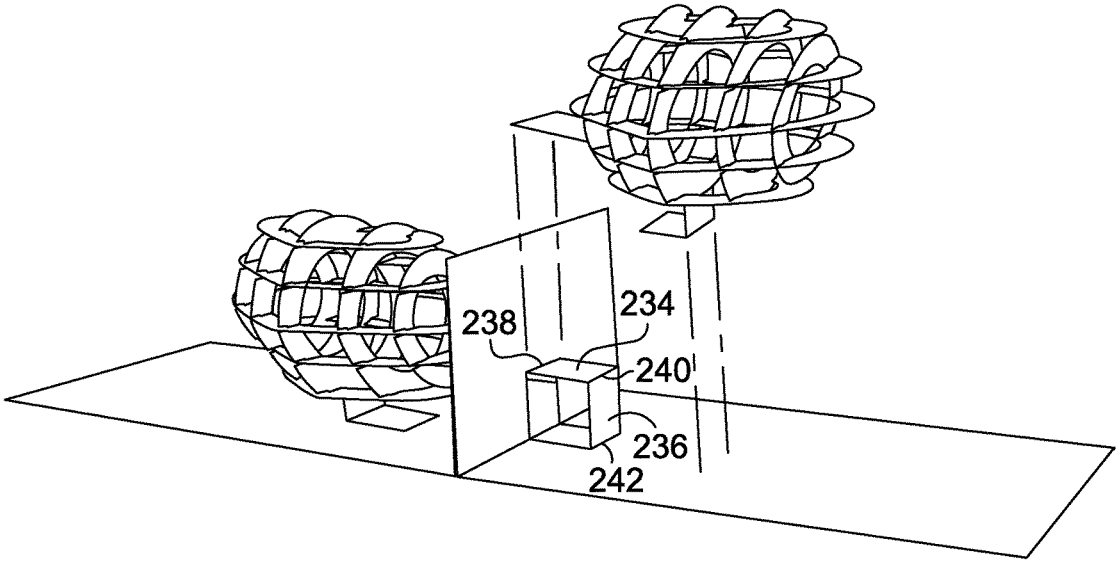
FIG. 30 depicts a perspective view of the foldable article of FIG. 29 with a sliceform detached from a paper mechanic, in accordance with aspects hereof.

In this embodiment, the paper mechanic 218 comprises a box lift. In FIG. 30 the sliceform 220 has been lifted away from the first panel 212 and the second panel 214. The paper mechanic 218 includes a first box fold 138, a first leg 234 extending from the first box fold 238 to a second box fold 240, and a second leg 236 extending from the second box fold 240 to a third box fold 242. The first box fold 238 is positioned between the first leg 234 and the first panel 212. The second box fold 240 is positioned between the first leg 234 and the second leg 236. The third box fold 242 is positioned between the second leg 236 and the second panel 214.

In this illustrated aspect, the paper mechanic 218 was formed by incising two parallel slits that extend from the first panel 212 to the second panel 214 normal to the fold 216 and popping out the first leg 236 and the second leg 238 away from the first panel 212 and the second panel 214. In other aspects, however, the first leg 234 may be affixed to the first panel 212, the second leg 236 may be affixed to the second panel 214, and/or the first leg 234 may be affixed to the second leg 236.

Figure 31:
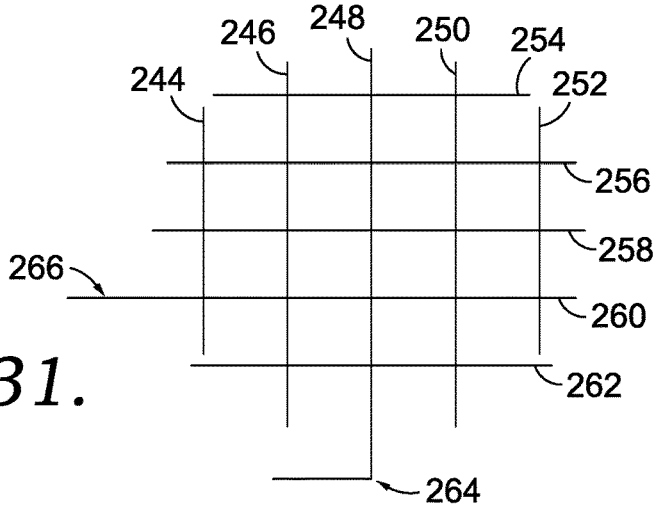
FIG. 31 depicts a front elevation view of a sliceform of the foldable article of FIG. 29, in accordance with aspects hereof.
Figure 32:
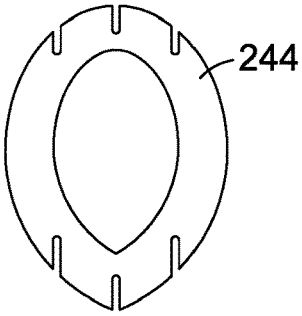
FIG. 32 depicts a top view of a planar element of the sliceform of FIG. 31, in accordance with aspects hereof.
Figure 33:
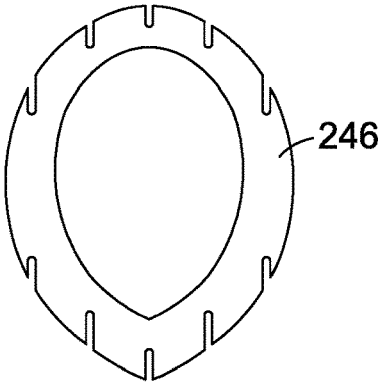
FIG. 33 depicts a top view of a planar element of the sliceform of FIG. 31, in accordance with aspects hereof.
Figure 34:
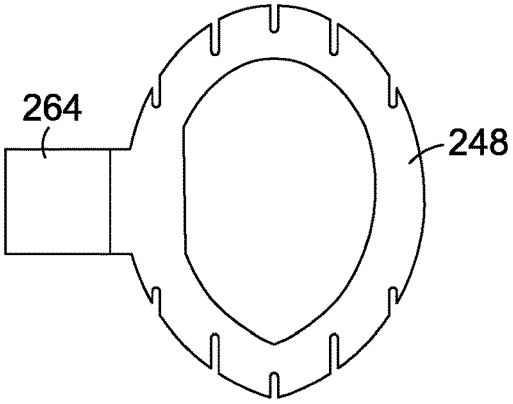
FIG. 34 depicts a top view of a planar element of the sliceform of FIG. 31, in accordance with aspects hereof.
Figure 35:
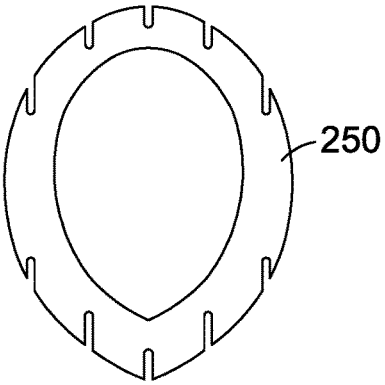
FIG. 35 depicts a top view of a planar element of the sliceform of FIG. 31, in accordance with aspects hereof.
Figure 36:
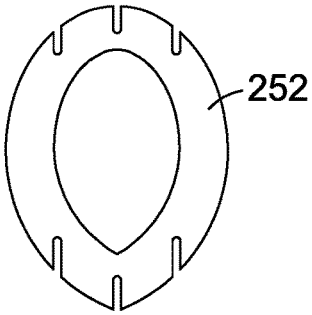
FIG. 36 depicts a top view of a planar element of the sliceform of FIG. 31, in accordance with aspects hereof.
Figure 37:
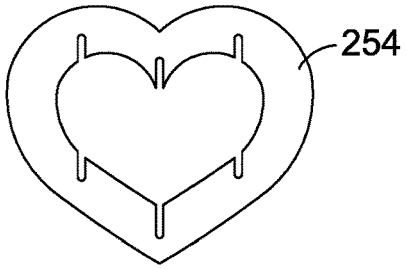
FIG. 37 depicts a top view of a planar element of the sliceform of FIG. 31, in accordance with aspects hereof.
Figure 38:
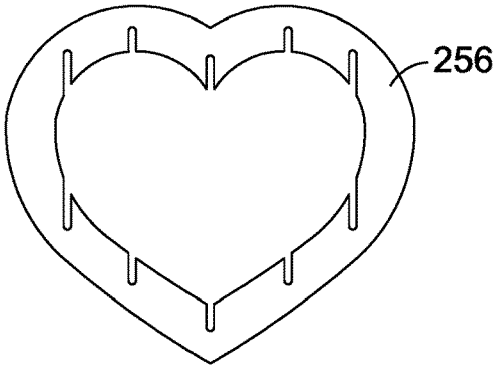
FIG. 38 depicts a top view of a planar element of the sliceform of FIG. 31, in accordance with aspects hereof.
Figure 39:
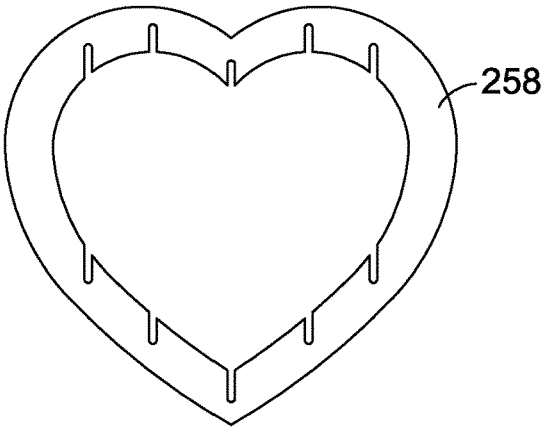
FIG. 39 depicts a top view of a planar element of the sliceform of FIG. 31, in accordance with aspects hereof.
Figure 40:
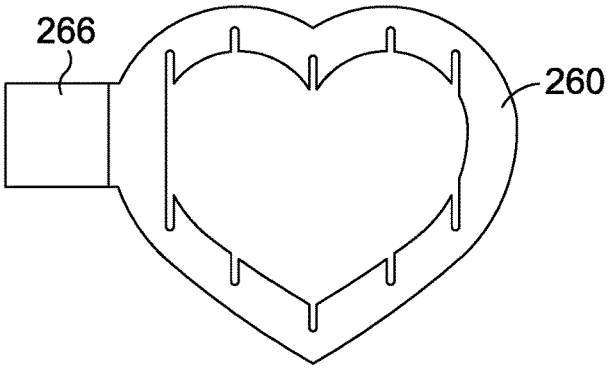
FIG. 40 depicts a top view of a planar element of the sliceform of FIG. 31, in accordance with aspects hereof.
Figure 41:
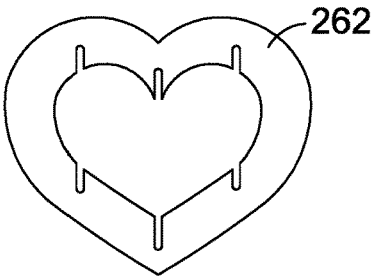
FIG. 41 depicts a top view of a planar element of the sliceform of FIG. 31, in accordance with aspects hereof.

Referring now to FIGS. 31-41, the sliceform 220 includes a first plurality of planar elements 244, 246, 248, 250, and 252 and a second plurality of planar elements 254, 256, 258, 260, and 262. The planar elements of the sliceform 220 are similar to those of the first embodiment discussed above, except that two of the planar elements have a tab extending from an edge. In the illustrated aspect, planar element 248 has a first tab 264 and planar element 260 has a second tab 266. FIG. 31 depicts a front elevation view of the sliceform 220 in an expanded state. FIGS. 32-36 depict the first plurality of planar elements 244, 246, 248, 250, and 252, which are substantially the same as the planar elements described above. FIGS. 37-41 depict the second plurality of planar elements 254, 256, 258, 260, and 262.

When the foldable article 210 is assembled, the first tab 264 extends beneath the sliceform 220 and is affixed to the second panel 214. Similarly, the second tab 266 extends laterally from the sliceform 220 and is affixed to the paper mechanic 218. In other aspects, the first tab 264 and the second tab 266 may not be integral to the sliceform 220 and instead may be separate portions affixed to the sliceform 220.

Similar to the embodiments discussed above, the foldable article 210 moves between a closed state and a fully open state (shown in FIG. 30). When the foldable article 210 is in the closed state, the paper mechanic 218 and the sliceform 220 are in a substantially two-dimensional, collapsed state. In other words, the paper mechanic 218 and the sliceform 120 lay flat within the foldable article 210 between the first panel 212 and the second panel 214. When the foldable article 210 is in the fully open state, the paper mechanic 218 and the sliceform 220 are in a substantially three-dimensional, expanded state. In the expanded state, the first plurality of planar elements 244, 246, 248, 250, and 252 are perpendicular to the second panel 214 and the second plurality of planar elements 254, 256, 258, 260, and 262 are substantially parallel to the second panel 214. Thus, in the expanded state the first plurality of planar elements 244, 246, 248, 250, and 252 are orthogonal to the second plurality of planar elements 254, 256, 258, 260, and 262.

Thus, as with the embodiments described above, it is no longer necessary for the sliceform 220 to be positioned such that it straddles the fold 216. Rather, it may be positioned at any location on either of the first panel 212 or the second panel 214. Further, the sliceform 220 may be affixed to the paper mechanic 218, and need not be affixed to either of the first panel 212 or the second panel 214. In so doing, the sliceform 220 may have a unique orientation such that the passageways defined by the planar elements 244, 246, 248, 250, 252, 254, 256, 258, 260, and 262 when in the expanded state need not extend normal to the first panel 212 or the second panel 214 when the foldable article 210 is in the fully open state. Moreover, one of the pluralities of planar elements may be oriented in planes parallel to at least one of the first panel 212 and the second panel 214 when the foldable article is in the fully open state. Greeting cards, and other foldable articles, are often opened and viewed from the top, thus the present invention permits the designer options to provide a design profile that may be viewed from the top rather than merely from the side.

Additionally, although some exemplary implementations of the embodiments described herein are shown in the accompanying figures, these implementations are not intended to be limiting. Rather, it should be understood that the various embodiments and aspects described herein may be implemented upon any foldable article have a paper mechanic that acutates a sliceform between a substantially two-dimensional, collapsed state and a substantially three-dimensional, expanded state.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed:

1. A foldable article comprising:

a panel having a surface;

a sliceform coupled to the panel by a paper mechanic, the sliceform comprising a plurality of first planar elements coupled to a plurality of second planar elements, the sliceform movable between a collapsed state wherein the plurality of first planar elements are substantially parallel to the panel and the plurality of second planar elements are also substantially parallel to the panel and an expanded state wherein the plurality of first planar elements extend in parallel to one another and at a first angle to the plurality of second planar elements, wherein the plurality of first planar elements and the plurality of second planar elements define one or more passageways extending through the sliceform in a first direction when in the sliceform is in the expanded state, wherein the first direction is parallel to the surface of the panel, wherein the paper mechanic comprises a criss-cross lift.

2. The foldable article of claim 1, wherein the foldable article comprises a greeting card.

3. The foldable article of claim 1, wherein the plurality of first planar elements are each coupled to at least one of the plurality of second planar elements at a first series of slots formed in one or more of the plurality of first planar elements and a second series of slots formed in one or more of the plurality of second planar elements.

4. The foldable article of claim 1, wherein the plurality of first planar elements are set at a second angle to the panel in the expanded state and the plurality of second planar elements are set at a third angle to the panel.

5. The foldable article of claim 4, wherein the second angle is 45 degrees and the third angle is 135 degrees.

6. The foldable article of claim 1, wherein the plurality of first planar elements are perpendicular to the plurality of second planar elements in the expanded state.

7. A foldable article having a folded state and an open state, the foldable article comprising:

a first panel separated from a second panel at a fold;

a paper mechanic coupled to the first panel and the second panel, wherein the paper mechanic extends across the fold;

a sliceform coupled to the paper mechanic, the sliceform positioned entirely on one side of the fold, the sliceform movable between a collapsed state and an expanded state, the collapsed state being associated with the folded state of the foldable article and the expanded state being associated with the open state of the foldable article; and wherein the paper mechanic is configured to move the sliceform from the collapsed state to the expanded state as the foldable article moves from the folded state to the open state.

8. The foldable article of claim 7, wherein the first panel and the second panel comprise a unitary panel and the fold comprises a crease in the unitary panel.

9. The foldable article of claim 7, wherein the first panel has a first edge and the second panel has a second edge, wherein the first edge is coupled to the second edge such that the first panel is foldable relative to the second panel.

10. The foldable article of claim 7, wherein the paper mechanic comprises a criss-cross lift.

11. The foldable article of claim 10, wherein the criss-cross lift comprises:

a strap having a first end opposite a second end, the first end coupled to the first panel;

a first leg having a third end opposite a fourth end;

a second leg having a fifth end opposite a sixth end;

the first leg coupled to the second leg intermediate the third end and the fourth end, one of the third end and the fifth end coupled to the second end of the strap and the other coupled to the second panel, the fourth end and the sixth end coupled to the sliceform.

12. The foldable article of claim 11, wherein the second end of the strap is positioned a first distance from the fold when the foldable article is in the folded state and a second distance from the fold when the foldable article is in the open state.

13. The foldable article of claim 7, wherein the sliceform is detachably coupled to the paper mechanic.

14. The foldable article of claim 13, wherein the detachable coupling between the sliceform and the paper mechanic comprises a slit-and-tab connection.

15. The foldable article of claim 7, wherein the paper mechanic comprises a box lift.

16. A foldable article having a folded state and an open state, the foldable article comprising:

a first panel coupled to a second panel at a first fold;

a paper mechanic coupled to the first panel and the second panel, wherein the paper mechanic moves in response to the foldable article moving from the folded stated to the open state;

a sliceform coupled to the paper mechanic, the sliceform comprising a plurality of first planar elements coupled to a plurality of second planar elements, the sliceform movable between a collapsed state and an expanded state, the sliceform being in the collapsed state when the foldable article is in the folded state, the sliceform being in the expanded state when the foldable article is in the open state.

17. The foldable article of claim 16, wherein the sliceform is not attached to the first panel or the second panel.

18. The foldable article of claim 16, wherein the plurality of first planar elements each have a central fold, wherein each of the plurality of first planar elements is folded when the slice form is in the collapsed state.

* * * * *